US005263909A

United States Patent [19]

Ehrenfried

[11] Patent Number: 5,263,909

[45] Date of Patent: Nov. 23, 1993

[54] DRIVE WITH TORQUE ARM SUPPORT FOR EXERCISE DEVICE

[75] Inventor: Ted R. Ehrenfried, Portsmouth, Va.

[73] Assignee: Alpine Life Sports, Suffolk, Va.

[21] Appl. No.: 933,337

[22] Filed: Aug. 24, 1992

[51] Int. Cl.[5] ..... A63B 22/04

[52] U.S. Cl. ..... 482/52; 482/6; 482/51

[58] Field of Search ..... 482/51-54, 482/6, 1, 7

[56] References Cited

U.S. PATENT DOCUMENTS 4,729,558 3/1988 Kuo ..... 482/54
5,114,388 5/1992 Trulaske ..... 482/52
5,180,351 1/1993 Ehrenfried ..... 482/6
5,184,988 2/1993 Dunham ..... 482/54

*Primary Examiner*—Stephen R. Crow
*Attorney, Agent, or Firm*—Raymond L. Greene

[57] ABSTRACT

A drive assembly for an exercise device is provided. The drive assembly is made up of a base with side supports and an electric motor drive mechanism. The electric motor drive mechanism is an electric motor with a worm gear attached to two driving pulleys via one way clutches. The drive mechanism is supported with outboard bearing mounts located in the side supports. A torque arm and spring assembly restricts rotation of the mechanism, but allows limited rotational movement. This limited movement attenuates shock torsional loads and as a result reduces the structural and electrical size requirements for the overall device.

8 Claims, 2 Drawing Sheets

DRIVE WITH TORQUE ARM SUPPORT FOR EXERCISE DEVICE

FIELD OF THE INVENTION

The invention is related to the field of exercise equipment and more particularly to low impact exercise equipment having motor-driven mechanisms.

BACKGROUND OF THE INVENTION

A variety of exercise devices including treadmills, cycles, stair climbers and other devices are known in the art and generally fall into two categories, motor driven and operator driven. In those devices incorporating motor driven technology, the operator induces certain shock loads on the operating system. For example, during the operation of a treadmill, as the operators foot impacts the moving belt a momentary stoppage of the belt occurs caused by the developed friction generated by the sudden download forces increasing the friction between the moving belts' undersurface and the treadmills stationary sliding surface. As a result, two undesirable loading forces occur, the first being mechanical and the second being electrical. These adverse mechanical forces are applied against the entire drive mechanism, the moving belt itself, the underlying sliding surface, the gears, pulleys, belts, drive mechanism, the driving motor and its bearings and even the motor mounting support structure.

Likewise, increased electrical current loads are induced in the entire electrical system, including wiring, components, and motors. As a result, the wiring must be oversized to accommodate the increased current, all switches and components must be oversized and the electrical motor itself must be oversized to avoid motor stall during peak torque demands. A leveling of the load in the typical installation, that is, averaging out peak and steady state loads, allows a reduction in the size of the electric motor and related components by approximately forty percent. This reduction can be seen in prior devices such as treadmills where the moving belt is suspended thereby limiting impact frictional forces.

Likewise, adverse mechanical load forces effect the entire structure of the exercise device. The belt must be stronger to absorb additional forces, gears and pulley mechanisms must be heavier, the bearings and motor support brackets must be larger and stronger. Devices such as stair climbers also incur mechanical and electrical shock loads during operation. As an operator steps from one pedal to another during stair climber operation, impact forces cause torsional forces to be applied throughout the drive mechanism, through the drive motor to the frame of the exerciser. These forces result in severe stresses on the motor support brackets leading to metal fatigue and cracking. In fact, the peak impact loads are transmitted through the entire mechanism thereby requiring larger electrical components and larger mechanical components.

Because of the expense of these oversized components and of the potential mechanical failure of the exercisers, various methods and techniques have been used to reduce or eliminate shock loads. These methods and techniques include providing motor-to-exerciser connections that can absorb some of the shock, such as using a pulley-drivebelt assembly to connect the driving motor to the exerciser operating component. Additionally, considerable prior art development has been accomplished in the area of reducing frictional effects on treadmill devices. In the stair stepper devices, some prior art devices have incorporated small spring devices at the pedal attachment points in order to provide a small amount of give at the pedal. None of these methods have been wholly satisfactory, and as a result, overdesign and oversizing of components is still required.

SUMMARY OF THE INVENTION

Accordingly, it is an object of the present invention to provide an exerciser drive assembly having mounts which absorb torsional shock loads.

It is a further object of the invention to provide an exercise drive assembly suitable for operation at a relatively constant electrical power load.

It is another object of the invention to provide an exercise drive assembly which induces only linear loads on the exerciser frame.

The invention is an exerciser drive assembly having a base with side mounting frames. An electric motor and worm gear mechanism having output shafts forming the top of a "T" configuration, is suspended by outboard bearing mounts on the side mounting frames. These outboard bearing mounts allow the entire drive mechanism to rotate and thereby preclude torsional forces on the side frames. Rotation of the drive mechanism is opposed by a torque arm attached by a spring to the frame.

The rotational movement of the entire drive mechanism, through an arc of approximately ten degrees, absorbs impact mechanical loads allowing a lightweight frame structure and reducing the electrical loads and the necessary size of the electrical drive motor.

BRIEF DESCRIPTION OF THE DRAWINGS

The foregoing objects and other advantages of the invention will be better understood from the following description taken with the accompanying drawings wherein like reference numerals refer to the same element throughout and wherein.

DETAILED DESCRIPTION OF THE INVENTION

Figure 1:
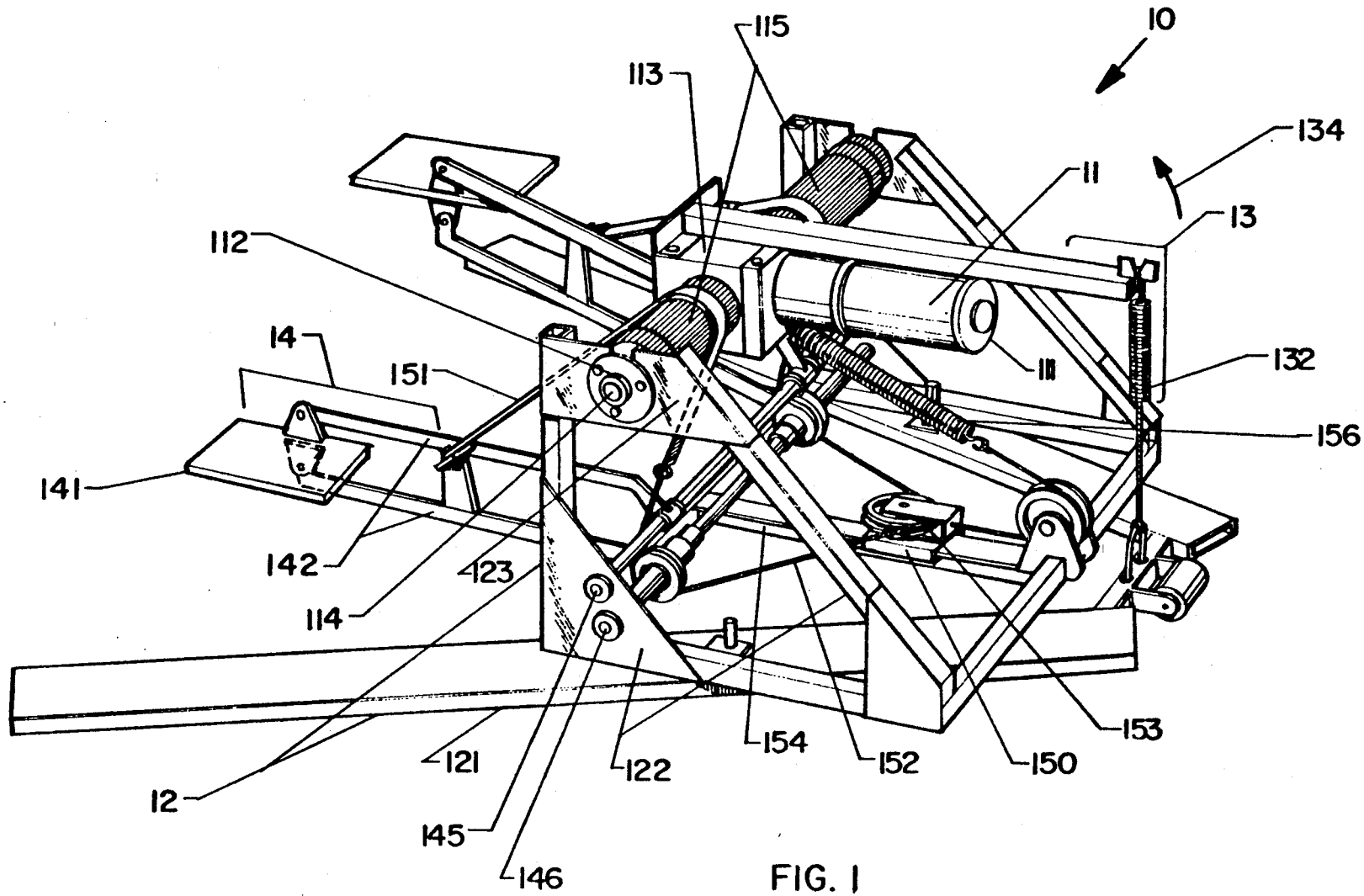
FIG. 1 is a perspective view of the exerciser drive assembly as applied to a step exerciser.

Referring now to FIG. 1, the exerciser drive assembly 10 is shown with the major components, drive mechanism 11, supporting frame 12, torque arm-spring assembly 13, and the user-operated mechanism 14.

The supporting frame 12 includes a base 121 and side supports 122. At the upper end of each side support 122, outboard bearing support plates 123, fabricated of stamped sheet metal, enclose outboard bearings 112. When restrained by outboard bearing supports only, the entire drive mechanism 11 is free to rotate and cannot impart torsional loads to the bearing support plates 123.

Drive mechanism 11 comprises electrical drive motor 111, gear drive assembly 113, dual output shafts 114, and drive pulleys 115. The interior details of worm gear assembly 113 comprise a conventionally-known worm gear drive and shaft arrangement.

The torque arm spring assembly 13 comprises torque arm 131 attached to drive mechanism 11 and spring-cable assembly 132 attached to base 121. The torque arm spring assembly 13 limits the rotational movement of drive mechanism 11 when rotating in a counterclockwise direction 134.

The user operated mechanism 14 comprises foot pedal 141, pedal supports 142, parallel axles 145 and 146 and pedal retractor mechanism 150. Pedal retractor mechanism 150 further comprises retractor belts 151 connected to the pedal supports and leading over drive pulleys 115 to operating cable 152. Operating cable 152 extends around retractor pulley 153 and connects to the opposite operating pedal. Retracting pulley 153 moves linearly along slider bar 154 depending on pedal load and the tension in the retractor spring 156. Retractor spring 156 is further affixed to drive mechanism 11 so as to provide a counterclockwise torque opposing the clockwise torque of spring assembly 132. The rotationally floating mount of drive mechanism 11 allows limited rotation of the torque arm so as to reduce forces applied from the pedals to the drive motor assembly. Likewise, no torsional forces can be applied to the side mounted plate due to the outboard bearings.

OPERATION OF THE INVENTION

Figure 2:
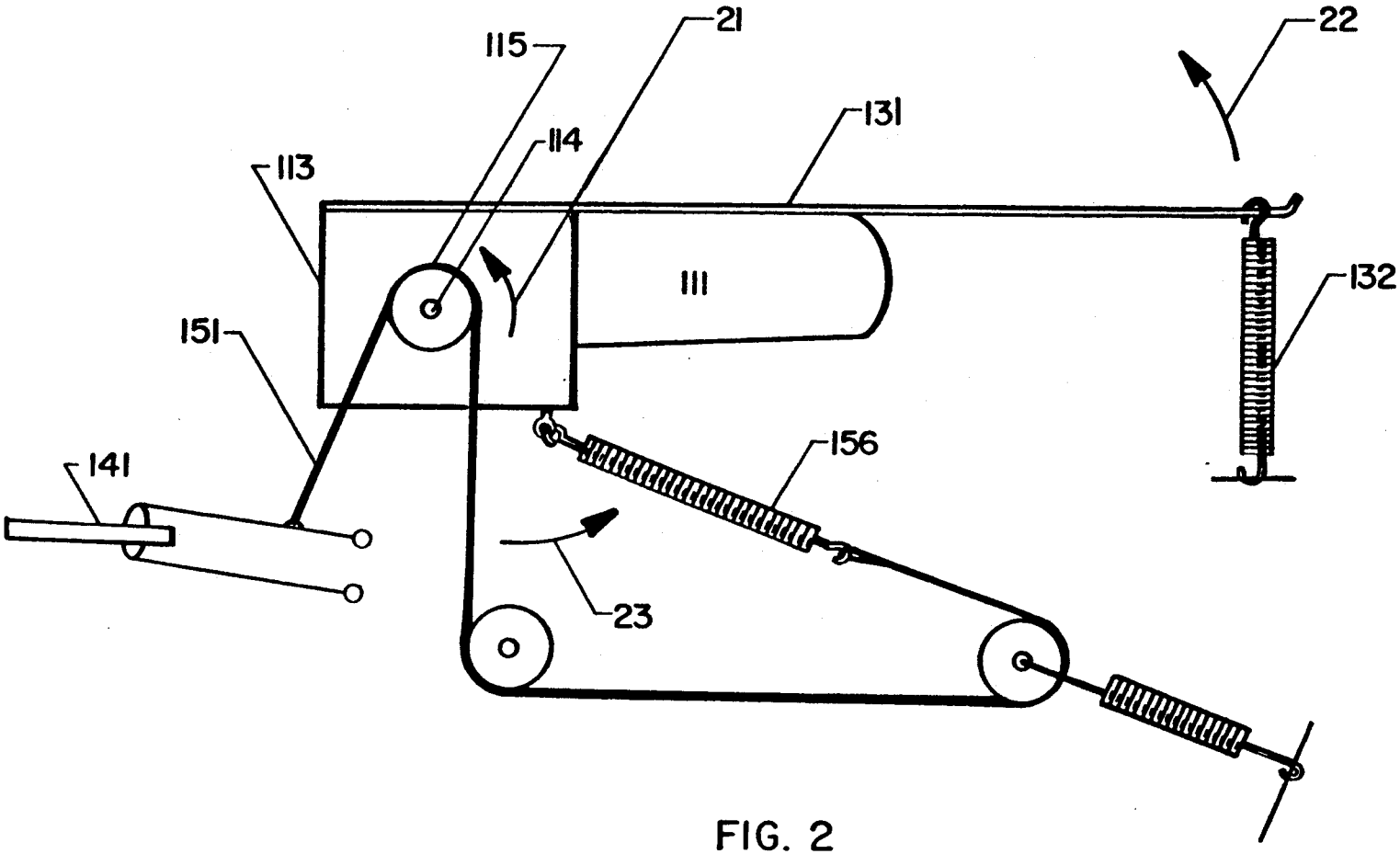
FIG. 2 is a side view schematic depicting operation of the drive assembly.

Referring now to FIG. 2, during operation of the invention and prior to user operation of the foot pedals 141, electric motor 111 is turning at a predetermined speed. Electric motor 111 through the worm gear assembly 113 drives output shaft 114 at a user-selected speed as depicted by arrow 21. Drive pulley 115 however remains stationary because one way clutches (conventionally known and not shown) disengage in a direction of rotation of the driven shaft 114. However when pulley 115 exceeds the speed of shaft 114 the one-way clutch engages thereby limiting the maximum speed of pulley 115. In this embodiment, the drive assembly is acting as a retarder device. When the operator presses down on pedal 141 pulling belt 151 down pulley 115 speeds up to match the speed of shaft 114. At that point, the pulley can move no faster. Any further load by the operator acts to provide a twisting force on the entire drive mechanism 11 as shown by arrow 22. This torsional load is resisted by torque arm 131 and spring assembly 132. However, the attenuating effect of the small rotation of drive mechanism 11 (shown by arrow 22) prevents impact loads from being transmitted to the drive mechanism. When there is no user load on the exerciser, spring 156 provides a balancing torque depicted by arrow 23. Spring 156 also serves as a return spring for pedals 141 by raising the pedal to its upper position when the user releases his pressure on the pedal.

As a result of the novel construction of this exerciser, no torsional loads are transmitted to the side mountings on the frame of the exerciser. Only linear forces are applied to the side mounts and the rotational forces are absorbed by the torque arm and spring assembly and return spring 156. Because of the leveling of the peak impact loads by the torque arm-spring assembly, it is possible to make much lighter frame members and side support members than a conventionally mounted drive assembly. Further, the allowed movement of drive mechanism 11 prevents peak electrical loads since it is not necessary to have as large a motor to prevent stalling. The motor may be smaller and lighter and the electrical components themselves may also be designed for lower current loads including the wiring switches and controllers. This drive assembly is adaptable to a variety of exercise devices including stair and ladder climbers, treadmills, or other devices which operate in such a manner as to allow the user to induce impact loads on the device.

Thus, although the invention has been described relative to specific embodiments thereof, it is not so limited and numerous variations and modifications thereof will be readily apparent to those skilled in the art in light of the above teaching. It is therefore to be understood that within the scope of the appended claims the invention may be practiced otherwise than as specifically described.

What is claimed is:

1. A drive assembly for an exercise device comprising:

a supporting frame for mounting assembly components;

a drive mechanism rotatably mounted on said frame;

means, attached to said drive mechanism, for reducing the amplitude of load forces during excercise on said drive mechanism; and means for attaching said driving mechanism to an exercise operating mechanism; said supporting frame comprises a base and opposing side supports having outboard bearing supports for the drive mechanism output shafts.

2. A drive assembly as in claim 1 wherein said outboard bearing supports are fabricated with stamped sheet metal.

3. A drive assembly as in claim 1 wherein said drive mechanism comprises an electric motor and worm gear assembly connected to drive pulleys by one-way clutches.

4. A drive assembly as in claim 1 wherein said drive mechanism provides motive power to the exercise operating mechanisms on the exercise device.

5. A drive assembly as in claim 3 wherein said drive, mechanism provides braking forces to the exercise operating mechanism on the exercise device.

6. A drive assembly as in claim 3 wherein said drive mechanism further comprise dual shafts extending to and supported by said supporting frame.

7. A drive assembly as in claim 1 wherein said means for attaching comprises operator pedal supports.

8. A drive assembly for an exercise device comprising: a supporting frame for mounting assembly components; a drive mechanism mounted on said frame;

means, attached to said drive mechanism, for reducing the amplitude of load forces on said drive mechanism during exercise, said means comprises a torque arm and spring assembly, a first end of the torque arm being attached to said drive mechanism and a second end of the torque arm being attached to the supporting frame by the spring assembly, thereby restricting rotational motion while allowing torsional impact forces to be attenuated by the torque arm spring; and means for attaching said driving mechanism to an exercise operating mechanism.

* * * * *